United States Patent [19]

Pryor

[11] Patent Number: 5,061,159

[45] Date of Patent: Oct. 29, 1991

[54] FLUID END FOR RECIPROCATING PUMP

[76] Inventor: Dale H. Pryor, 3709 Southridge, Rowlett, Tex. 75088

[21] Appl. No.: 572,827

[22] Filed: Aug. 27, 1990

[51] Int. Cl.[5] ..... F04B 21/04

[52] U.S. Cl. ..... 417/554; 417/454; 417/569

[58] Field of Search ..... 417/554, 553, 569, 454, 417/570; 137/533.15, 539, 539.5

[56] References Cited

U.S. PATENT DOCUMENTS

| | | | |
|---|---|---|---|
| 3,446,156 | 11/1966 | Lightfoot | 417/554 |
| 3,465,787 | 9/1969 | Gulick | 137/539.5 |
| 4,541,779 | 10/1985 | Birdwell | 417/454 |
| 4,945,945 | 8/1990 | Schmid | 137/533.15 |

*Primary Examiner*—Leonard E. Smith

*Assistant Examiner*—Charles G. Freay

*Attorney, Agent, or Firm*—Marcus L. Bates

[57] ABSTRACT

A pump apparatus for moving fluid, such as drilling mud. The pump has a special designed fluid end of a configuration that reduces stress riser and therefore reduces the frequency of broken pumps. The pump has a cylindrical liner within which a special piston reciprocates. A stationary discharge valve of special design is connected to discharge fluid from the pump working chamber. A traveling valve is included in the piston and supplies fluid to the working chamber of the pump. The traveling and stationary valves each have a seal that also forms part of a valve seat. Each of the valve elements is a hollow ball and each ball is sealingly seated against the seat. The pump liner, piston, and discharge valve assembly are all axially aligned and can be easily removed from the discharge end of the pump.

10 Claims, 3 Drawing Sheets

FLUID END FOR RECIPROCATING PUMP

BACKGROUND OF THE INVENTION

A fluid end refers to that part of a pump apparatus which actually moves fluid from a pump inlet to a pump discharge. In a piston type pump, this would comprise the cylinder or liner, the piston, and the valves. This invention is directed toward a different type of fluid end for use primarily in the oil well drilling industry, and more specifically, to a fluid end for pumping mud from a mud supply into a drill string.

During the last twenty years or so, most of the oil well drilling pumps, called mud pumps, have been of the single acting piston type. The fluid end is usually arranged as shown on pages 2 and 3 of the IADC Drilling Manual, FIGS. J1 through J6. While placement of the valves may vary from one pump to another, the overall arrangement and fluid flow is about the same. The valves are designed such that the flow of fluid is in one direction only, that is, as the piston is moved to increase the volume in the variable chamber of the fluid end, the suction valve opens, allowing fluid to fill that volume. As the piston moves in the other direction, the suction valve closes, and the discharge valve opens, moving the fluid from the variable chamber into the discharge line. This design, while it works, has several serious drawbacks; primarily in the fluid end body itself. The fluid end body provides a fluid passage that extends from the suction valve, to the liner piston, to the discharge valve, and this passage must be large enough not only for the fluid passage but also for installation and removal of the valves, and with some designs, also the liner. The intersection of the various bores as well as the physical size thereof form a high stress area at the juncture of these bores. Fatigue cracks occur at these stress risers, resulting in early fatigue failure of the fluid end.

Another problem that can occur in the body of many prior art fluid ends is the installation of the valve seat into the body. If these parts are not properly installed, or if the seat or body has any flaw or debris that would keep the seat from fitting the body properly, the fluid will eventually erode or cut a passage from the high pressure side, about the valve seat, and to the lower pressure side, resulting in excessive erosion and the requirement of early replacement of the valve or the fluid end body.

It is believed that this invention eliminates the first problem, and, while it may not completely eliminate the erosion problem, it should significantly reduce the replacement cost thereof.

In approaching the first problem, it was recognized that the intersecting bores must be eliminated. This is accomplished by the present invention by placing one of the valves in the pump piston itself and using a horizontal type valve rather than the usual vertical valve. When the valve is relocated into the piston, then the piston rod must pass through a seal. This rod seal is placed on the low pressure or suction side of the piston or working chamber. The problem with this unique design is its horizontal orientation. A prior art type valve used in this new design would exhibit accelerated wear by the fluid being pumped, and this would prevent the valve from seating properly, and therefore bring about early valve failure. This problem is solved by the provision of a unique ball valve assembly. The ball valve rolls in a cage, rather than sliding in a guide and therefore cannot get cocked as with the present known valve arrangement. Further, to prevent the weight of the ball from becoming a problem due to the inertia of the reciprocating piston, particularly in the larger sizes and in the piston installed valve, a hollow ball is proposed. In most cases, the ball weight will be adjusted to less than four pounds per gallon of displaced fluid, and may therefore be made to actually float in eighteen pound per gallon mud, for example.

SUMMARY OF THE INVENTION

This invention comprehends a pump apparatus for moving fluid from a relatively low pressure fluid inlet thereof to a relatively high pressure discharge thereof. The pump has a fluid end that includes a cylindrical liner, with a piston being reciprocatingly received within the liner and forming a variable chamber therewith. A stationary discharge valve assembly is connected to exhaust fluid from the variable chamber. A traveling intake valve assembly is attached to and forms part of the piston and is connected to supply fluid to the variable chamber. The arrangement of the cylindrical liner, traveling valve and piston, and stationary valve provides a unique structure that eliminates stress risers and further simplifies maintenance and overhaul of the pump apparatus.

The piston has a low pressure end to which a shaft is connected for reciprocation of the piston, and a high pressure end opposed to the low pressure end. The piston sealingly engages the cylindrical wall surface of the liner. A valve seat is formed on part of the piston. A seal means for the piston includes part of the valve seat and can be of unitary construction. A passageway is formed through the piston and through the seat. A valve element is captured in part of the passageway adjacent the seat whereby the valve element is sealingly seated against the seat when the piston reciprocates to reduce the volume of the variable chamber, whereupon fluid is forced from the variable chamber and out of the discharge valve.

The stationary discharge valve assembly has a stationary valve body that is removably received within an end portion of the liner. Removal of the discharge valve gains access to the piston, and the piston also can be removed through the discharge end of the liner. The valve element preferably is a hollow ball having a cavity formed therein that can be of a selected size that provides any predetermined desired volume/weight ratio.

A primary object of the present invention is the provision of a mud pump having a fluid end within which there is formed a piston having a traveling valve associated therewith and a stationary valve arranged along a common axis and slidably received within a liner in a removable manner whereby stress risers are eliminated from the structure.

Another object of the invention is to provide a traveling valve in combination with a power piston for use in the fluid end of a high pressure pump wherein the piston has a seal means that also forms a valve seat, and a spherical hollow ball received against the seat.

A further object of this invention is to disclose and provide a discharge valve for the fluid end of a mud pump that is removably received in the discharge marginal end of a liner, and further including a combination valve seat and seal by which the valve assembly is sealingly received in the liner and which forms a seat for a valve element.

A still further object of this invention is the provision of an improved fluid end for a mud pump having a removable liner within which there is removably received a stationary discharge valve and a reciprocating piston having a traveling valve associated therewith, all of which are axially aligned respective to one another and all of which can be removed from the discharge end of the pump.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
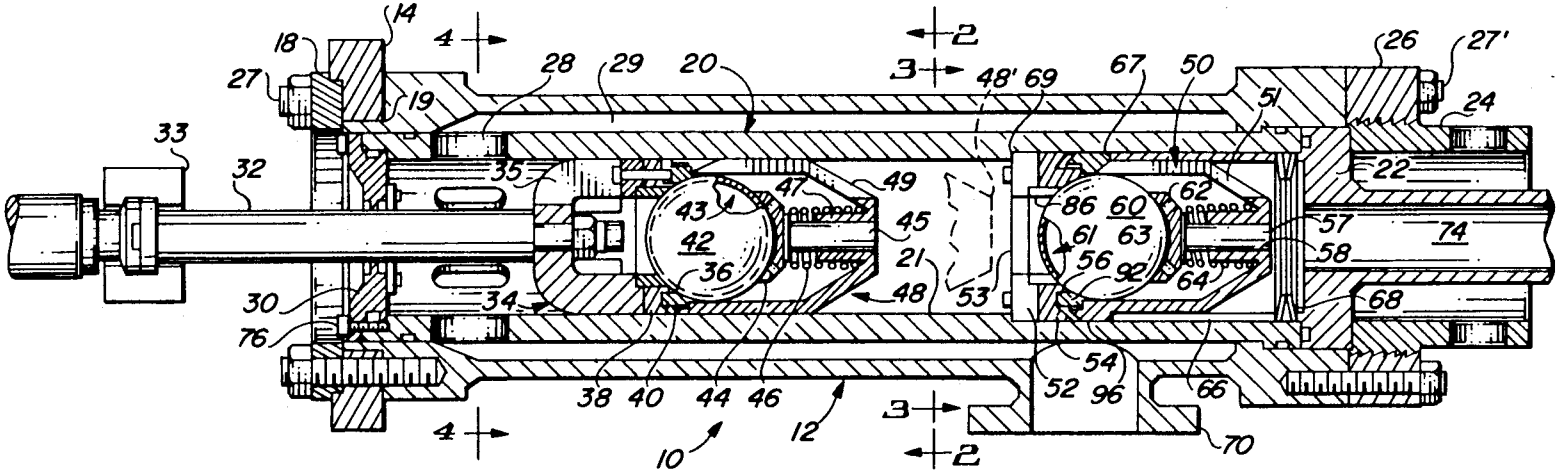
FIG. 1 is a longitudinal, cross-sectional view of a fluid end for a pump apparatus, made in accordance with the present invention.
Figure 4:
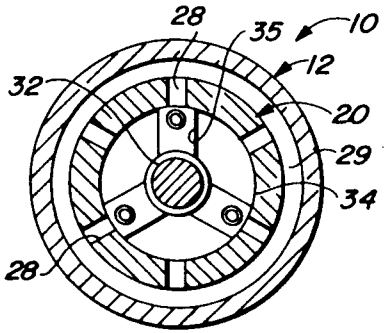
FIG. 4 is a cross-sectional view taken along line 4—4 of FIG. 1.
Figure 3:
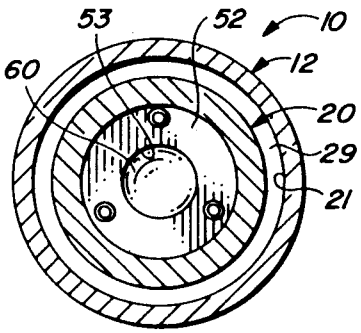
FIG. 3 is a cross-sectional view taken along line 3—3 of FIG. 1.
Figure 2:
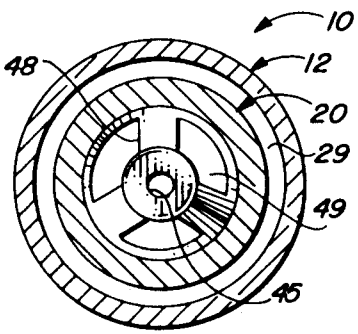
FIG. 2 is a cross-sectional view taken along line 2—2 of FIG. 1.

FIG. 1 of the drawings broadly discloses the preferred embodiment of a pump apparatus 10 made in accordance with the present invention. The pump apparatus 10 has a main body 12 which is supported from a suitable framework 14 of any suitable design. Retainer ring 18 is received within the indicated annulus of framework 14 and supportingly engages the inlet end of a pump liner 20 therewithin. Numeral 21 indicates the inner, cylindrical, peripheral wall surface of liner 20.

Cylinder head 22 is of annular construction and has an inner face and an outer face by which it is mounted between the discharge end of liner 20 and a cylinder head lock 24. Annular flange 26 is attached to main body 12 by means of studs 27, 27'. The studs 27 and 27' are in tension and therefore urge retainer ring 18 against framework 14 and annular flange 26 towards members 14 and 18, with the main body 12 being compressed therebetween, and thereby holding all of the components 12, 14, 18, and 26 in assembled relationship respective to one another. As noted, the cylinder head lock 24 has apertures formed therein for applying rotational force thereto and thereby unthreading the illustrated threaded connection formed between members 24 and 26, whereupon the cylinder head 22, along with liner 20, may be removed from the main frame.

Radial ports 28 connect the interior 21 of liner 20 with inlet annulus 29. Seal carrier 30 and piston rod 32 are coupled at 33 to a suitable source of power that strokes piston rod 32 axially along a predetermined marginal length of liner 20 as indicated by the dot-dash lines within the expansion chamber.

Piston 34 has a piston head which is hollow and has radial inlet slots or intake ports 35 formed therein. The piston 34 is provided with an annular seal 38 that is mounted within confronting opposed marginal ends of piston 34, and is held against an annular seal retainer 40 by fastener means received through bolt holes 37'. A hollow ball valve element 42 is received against an inner annular portion 36 of seal 38 while an outer diameter of seal 38 bears against the inner wall surface 21 of the liner.

A follower 44 has a reduced diameter extension 45 reciprocatingly received within a central bore of a cage 48. Spring 46 is received about a bushing guide 47 and urges the follower 44 against the outer surface of the ball, and the ball is biased against the traveling valve seat retainer 37 and seal retainer 40. Radial ports 49 are spaced circumferentially about cage 48 and provide a fluid flow path from the traveling valve assembly into the variable chamber.

A standing valve assembly 50 defines the discharge end of the variable chamber, while piston 34 defines the intake end of the variable chamber. The standing valve assembly 50 has a cage, similar to cage 48, within which radial ports or slots 51 are formed on the discharge marginal end thereof, and a seat backup ring 52 is formed on the intake side thereof and provides a passageway 53 through which fluid can flow. Annular seal 54 divides the standing valve into opposed marginal lengths, seals the interface between the standing valve and the liner 20, and provides a resilient seat at 56. A reduced diameter extension 57 is reciprocatingly received within a bushing 58. The bushing forms part of the valve cage. Ball valve element 60 has a hollow interior 61 which can be varied in volume to adjust the weight-volume ratio of the ball valve element 60.

The outer surface of ball valve element 60 bears against a follower 62. Each of the followers, 44 and 62, have ports 63 formed therein. Spring 64 urges follower 62 against the outer face of ball valve element 60. Seat retainer 66 is in the form of a sleeve and has one end urged against an annular shoulder 67 of the cage while the opposed end is urged against a seat retainer annular spring assemble 68 of commercial design. The retainer spring assembly 68 is compressed between seat retainer 66 and cylinder head 22, while the stationary or standing valve assembly 50 is urged against annular shoulder 69 formed in the discharge marginal end of liner 20.

Numeral 70 indicates a suction manifold flange that forms an inlet which communicates with the inlet annulus 29. Outlet 74 forms the downstream end of a discharge flow passageway which extends through the discharge valve annular spring assembly 68 and communicates the interior of the stationary or standing valve assembly 50 with the pump discharge or outlet 74. It will be noted that the high pressure marginal end of the piston valve assembly and the stationary valve assembly are similar in construction and many of the components thereof can be interchanged.

Figure 5:
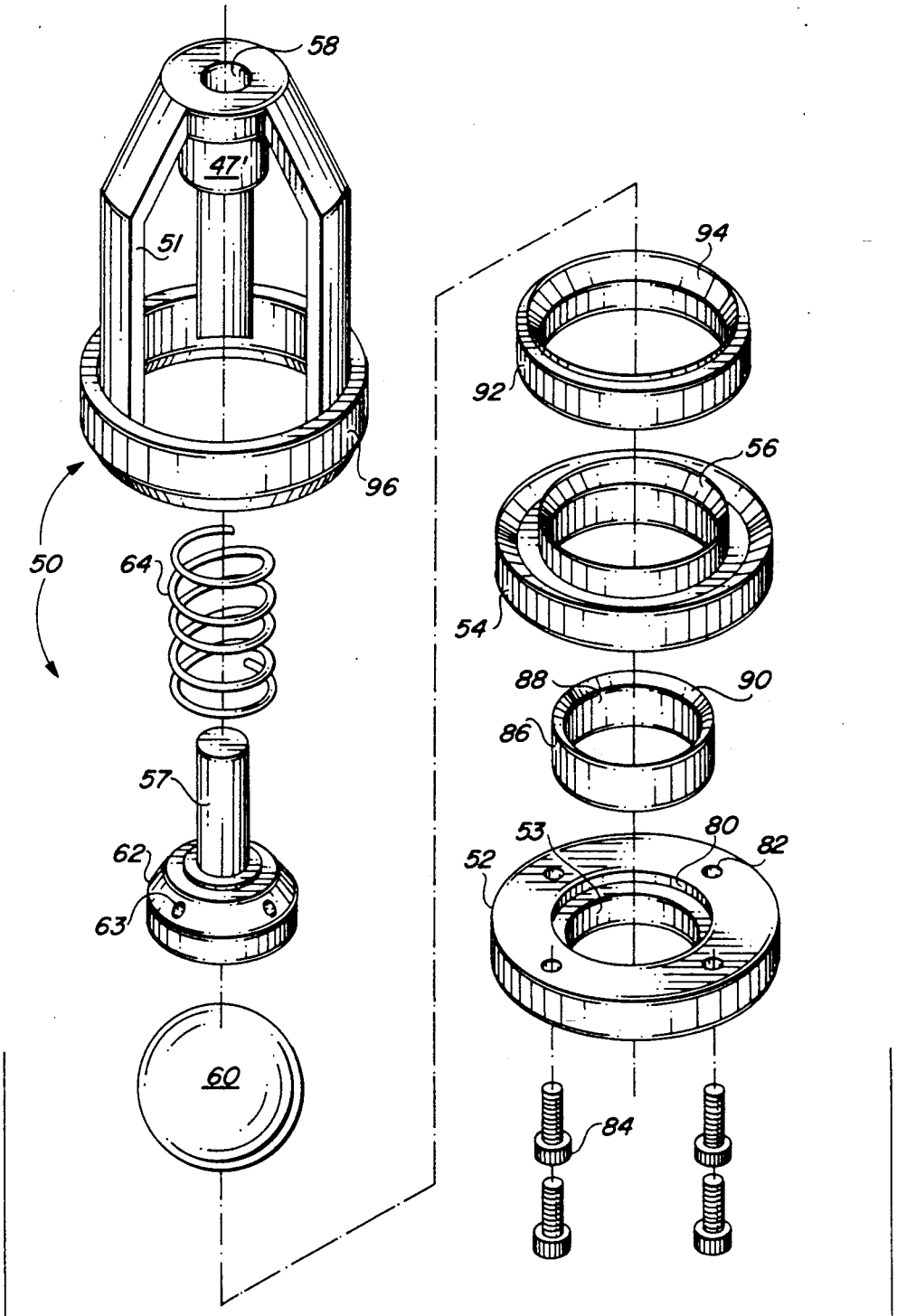
FIG. 5 is an enlarged, exploded, perspective, detailed view showing some of the apparatus disclosed in FIG. 1; and, FIG. 6 is an enlarged, exploded, perspective, detailed view of part of the apparatus disclosed in FIG. 1.
Figure 6:
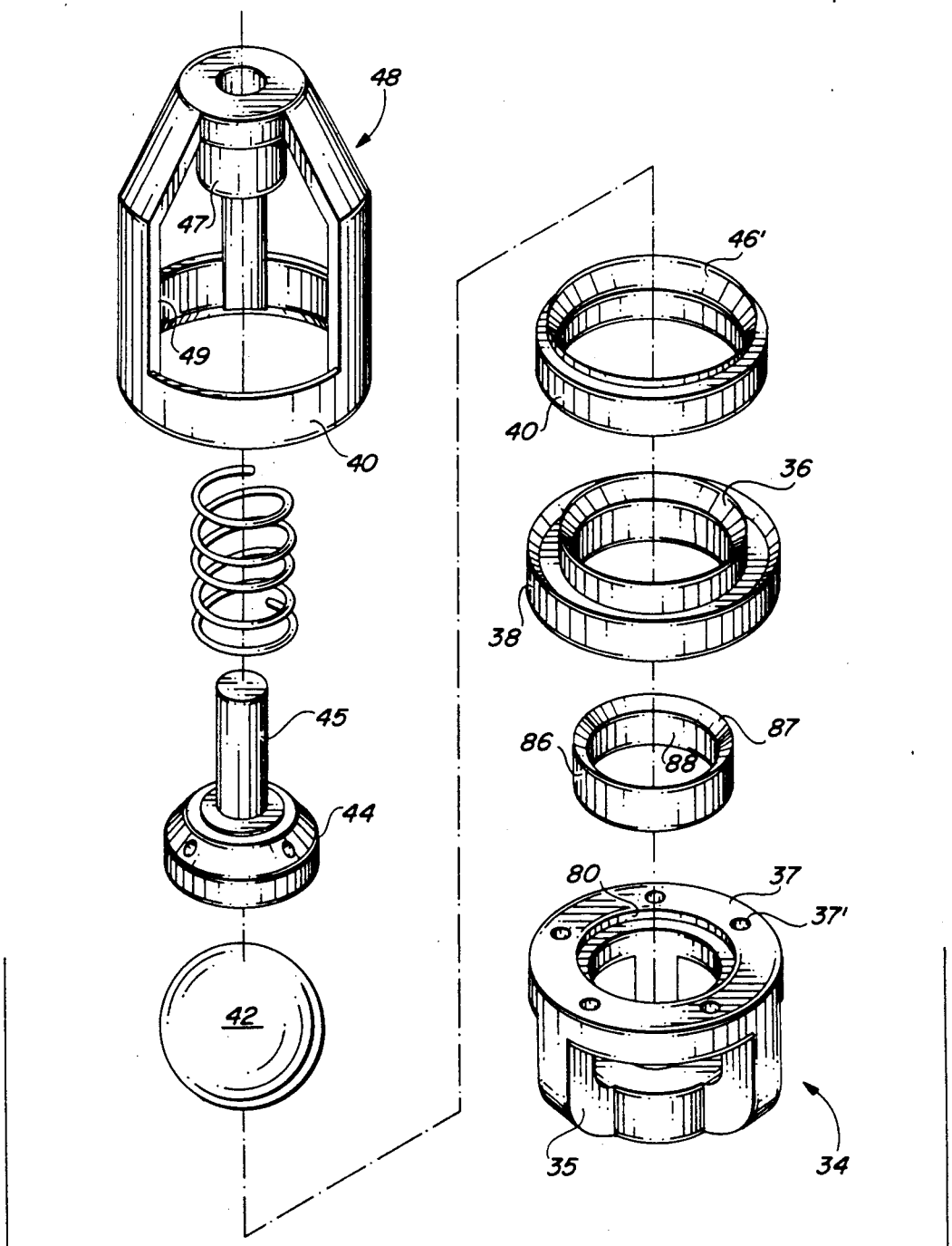

In FIGS. 1, 5, and 6, the inside diameter 80 of the seat back-up ring 52 has bolt holes 82 arranged thereabout in a suitable bolt circle for receiving a suitable fastener means 84 therethrough that extends into attached relationship respective to member 96. Annular ring 86 is received within the seat back-up ring 52 and forms part of an axial flow passageway as seen at inside diameter 88. Conical surface 90 forms an inner marginal length or part of the valve seat. Outer seat element 92 has a conical surface 94 formed thereon that forms an outer marginal length of the valve seat. Surfaces 56, 90, and 94 jointly cooperate together to form the traveling or piston valve seat against which the hollow ball valve element 42 is sealingly received. The annular cage member 96 is removably affixed to the seat back-up ring 52 with the illustrated confronting faces thereof abuttingly engaging the annular seat members 54, 86, 92 which are held in assembled relationship therebetween.

In the present invention, the liner 20 and housing are made separate from one another, with the stationary valve assembly 50 being formed in a subassembly, and the intake valve assembly being made part of the piston assembly. The entire piston assembly and stationary valve assembly can be moved axially through the discharge end of the fluid end upon removal of the cylinder head. This unique construction avoids the presence of sharp edges and threaded areas that create the stress risers associated with the intersection of various bores, and further reduces the size of the bores. The elimination of sharp edges, corners, and threads, all of which create stress risers in the high stress area of the fluid end, is thereby obviated. This avoids fatigue cracks which are associated with these high stress areas found in the fluid end of other mud pumps.

The valve seats of both the traveling and stationary valves are of a configuration to provide a seal means between the liner 20 and the valves as well as providing an intake seat and a discharge seat. Both the fixed and traveling valves are easily removed from the fluid end as described.

The present invention therefore includes a novel intake and discharge valve assembly, each having a valve element in the form of a hollow ball that cooperates with a novel valve seat in a new and unobvious manner.

The entire discharge valve assembly is easily removed from the discharge end of the pump assembly by first removing the cylinder head lock 24 and thereafter removing cylinder head 22 from the discharge end of the main body, thereby gaining access to the stationary discharge valve. The seat retainer spring assembly 68 is removed and thereafter the entire stationary discharge valve assembly is removed from the enlarged counterbore found at the discharge end of the liner 20.

The liner 20 can be removed at this time by first removing bolts 76 from the seal carrier 30 and thereafter removing the liner 20 from the main housing in a discharge direction. The piston assembly can be removed from the liner 20 by first removing the seal carrier and clamp 33, whereupon the piston can be removed from the discharge end of the liner 20; or alternatively, the piston can remain within the liner and the liner removed in a discharge direction as may be desired.

In operation, the invention is shown in FIG. 1 of the drawing with the piston at midstroke and with both valves closed. As the piston is moved toward the left (suction), the piston or traveling valve will open, allowing fluid to be drawn from the suction manifold, through the annulus between the frame and the liner, through the liner intake ports, into the suction end of the liner, and finally through the piston valve into the variable chamber of the liner itself. Note that fluid taking this route is surrounding the liner, providing some cooling effect, which in prior art fluid ends must be provided by an external source.

Moving the piston to the right closes the piston valve and opens the discharge valve, producing the pressure stroke. At the same time, more fluid is drawn into the suction or lower pressure side of the piston. This later action has a tendency to dampen the pulses in the suction manifold because the flow is not brought to an abrupt stop during the pressure stroke as it would otherwise occur in prior art pumps currently in use. The discharge flow characteristics, however, are not appreciably changed, other than the linear flow characteristics that is achieved with the present concentrically and axially aligned fluid end components.

Another new concept found in this invention is the easy and simple replacement of all working parts in the form of a cartridge-like assembly. With the exception of the cylinder head and the cylinder head lock, all remaining parts, including the piston rod, form an assembly that takes on the form of a cartridge, which can be inserted and removed as one sub-assembly or one unit. Maintenance is therefore made easy by this new and novel concept. To remove the cartridge, one should first disconnect the discharge manifold, then the piston rod clamp, and the cylinder head lock. Next, remove the cylinder head and then the cartridge is pulled out the discharge end of the pump (to the right).

All high pressure seals of the fluid end are located on the "expendable" items other than the cylinder head, therefore, if leakage occurs between the high and low pressure side, causing erosion, the parts to be replaced are the ones which under normal maintenance would be replaced anyway. All seals external to the cartridge are of low pressure design and should leakage occur, erosion on the metal parts is not likely to be of any great significance. This unexpected advantage provided by the present invention is not found in the prior art and imparts novelty into the mud pump of the present invention.

Other advantages are apparent after studying the drawing, such as, for example, the cost of the fabricated fluid end body as compared to the expensive forged and extensively machined body as presently used in the prior art mud pump devices. Overall lighter weight is also an advantage that can be realized in helicopter transportable pumps.

What is claimed as my invention is the overall concept and design of a fluid end that uses ball valves in an oil field type pump, the use of hollow balls in a ball type check valve, and the novel cartridge type replacement of "expendable" fluid end parts. Further claimed is the novel cylindrical liner and discharge valve arrangement that captures a simple cylindrical liner in a manner such that stress risers are eliminated from the high pressure pump assembly. There need be no threads or sharp corners in such a fluid end, and such a unique combination was heretofore unknown in the pump art.

I claim:

1. A pump for moving fluid from a suction side to a discharge side thereof, the pump having a fluid end that includes a main frame and a cylindrical liner, a piston reciprocatingly received in the liner and forming a variable chamber therewith, the piston sealingly engages the wall surface of the liner in a slidable manner; a stationary valve means connected to exhaust fluid from the variable chamber to the discharge side, an intake traveling valve means supported on the piston and connected to supply fluid from the suction side to the variable chamber; the piston has an inlet end to which a shaft is connected, and an outlet end opposed to the inlet end, the improvement comprising:

a valve cage and valve seat attached to said piston, a passageway formed through the piston and through the seat through which fluid flows into the variable chamber, a valve element in said passageway that is sealingly seated against the seat on alternate piston strokes;

said piston has an inlet marginal end opposed to an outlet marginal end, said outlet marginal end includes said valve cage and said valve element is captured within said cage;

said stationary valve means having a stationary valve cage that includes a passageway that extends longitudinally therethrough and is aligned with said piston, liner, and traveling valve cage; said stationary valve cage is removably received within said liner and said liner is removably received within said main frame;

said stationary valve means includes a circumferentially extending seal means that sealingly engages the liner sidewalls and forms the seat against which the ball valve element is received; said traveling valve and said stationary valve each have a valve element in the form of a hollow ball that provides the valve element with a reduced density;

said valve cage is axially aligned with said piston, liner, and traveling valve; and said stationary valve cage has a ball valve element therein that permits unidirectional flow from the variable chamber therethrough;

a cylinder head at the discharge end of the liner, said cylinder head has an axial passageway therethrough; intake ports in the inlet end of the liner, said stationary valve is mounted in a marginal end of the liner at a location between the piston and cylinder head whereby the variable chamber is located between the piston and the stationary valve, and the cylinder head can be removed to enable the piston, traveling valve, standing valve, and liner to be removed from the main frame.

2. The improvement of claim 1 wherein said piston has a circumferentially extending seal means that seals the outer wall of the piston to the inner wall of the liner and further forms said valve seat against which the valve element is received.

3. A pump apparatus for moving fluid from a low pressure fluid inlet thereof to a relatively high pressure discharge thereof, said pump apparatus includes a main frame and a liner, said liner is a cylindrical member that is held removably compressed within the main frame by a cylinder head, said high pressure discharge includes an axial passageway that extends through said cylinder head;

a piston reciprocatingly received in one marginal end of said liner and forming a variable chamber therewith, a stationary discharge valve means removably received within the other marginal end of the liner and connected to exhaust fluid from the variable chamber through said high pressure discharge;

said stationary discharge valve means includes a stationary valve body that has a passageway extending therethrough that is axially aligned with said piston and liner; traveling intake piston valve means attached to and forming part of said piston and connected to supply fluid from said low pressure fluid inlet to said variable chamber;

said traveling piston valve means and said stationary discharge valve means each have a caged hollow ball valve element that provides a reduced weight/volume ratio, and a valve seat formed in said piston valve means and said stationary valve means; said discharge valve means has a diameter that is at least the diameter of the piston;

said cylinder head is of annular construction and is removably supported within said main frame for holding the liner and discharge valve means in assembled relationship within the main frame;

whereby said cylinder head is removed from the main frame and the discharge valve, liner, and piston can be moved axially away from the main frame.

4. The pump of claim 3 wherein the traveling and stationary valve means each include a circumferentially extending seal means that sealingly engages the liner interior sidewalls and also form the seat against which the ball valve element is received.

5. The pump of claim 3 wherein said piston has a circumferentially extending seal means thereon that seals the outer wall of the piston to the inner wall of the liner and further forms said valve seat against which each of the valve element is received.

6. The pump of claim 3 wherein said piston has a downstream part removably affixed to an upstream part, said downstream part is in the form of a valve cage within which a ball valve is captured, seal means between the downstream and the upstream parts that concurrently sealingly engage the liner interior wall and form a seat for the ball valve.

7. A pump includes a main body having a fluid end for moving fluid from a suction side to a discharge side thereof, a cylinder supported by the main body, a piston reciprocatingly received in one end of the cylinder and forming a variable chamber therewith, a stationary discharge valve assembly supported at the other end of the cylinder and connected to discharge fluid from the variable chamber, a traveling intake valve assembly in said piston connected to supply fluid to said variable chamber, the improvement comprising:

said piston has an upstream marginal end to which an operating shaft is connected, and a downstream marginal end opposed to said upstream marginal end, seal means on said piston sealingly engages the wall surface of the cylinder, means forming a seat in said traveling intake valve assembly in said piston and in said stationary discharge valve assembly, a passageway through the piston and through the seat;

said stationary discharge valve assembly and said traveling intake valve assembly each including a valve cage, and a valve element is captured within each said valve cage and is sealingly seated against the seat on alternate strokes of the piston; a cylinder head for holding said discharge valve cage in said cylinder and for holding said cylinder within said main body; an axial passageway through said cylinder head; whereby;

said cylinder, said piston and said stationary discharge valve assembly are removably received in one end of said main frame and are axially aligned with respect to one another, and can be removed from said main frame upon removal of said cylinder head.

8. The pump of claim 7 wherein said traveling valve and said stationary valve each have a valve element in the form of a hollow ball that provides the valve element with a reduced effective density, said discharge valve cage is slidably received in a removable manner in a marginal end of said cylinder while it is held in place by said cylinder head.

9. The improvement of claim 8 wherein said traveling and stationary valves each include a circumferentially extending seal means that sealingly engages the cylinder sidewalls and form the seat against which the ball valve element is received.

10. The improvement of claim 8 wherein said piston has an upstream marginal end to which an operating shaft is connected, and a downstream marginal end opposed to said upstream marginal end, seal means on said piston sealingly engages the wall surface of the cylinder, said seal means forms a seat in said piston, said valve element is captured in the downstream marginal end and in said passageway and is sealingly seated against the seat on alternate strokes of the pump.

* * * * *

UNITED STATES PATENT AND TRADEMARK OFFICE

CERTIFICATE OF CORRECTION

PATENT NO. : 5,061,159
DATED : October 29, 1991
INVENTOR(S) : Dale H. Pryor

It is certified that error appears in the above-indentified patent and that said Letters Patent is hereby corrected as shown below:

Column 8, line 21, substitute "each of the" for --said traveling piston--.

Signed and Sealed this

Ninth Day of August, 1994

Bruce Lehman

*Attest:*

BRUCE LEHMAN

*Attesting Officer*

*Commissioner of Patents and Trademarks*